US007655175B2

(12) United States Patent
Michael et al.

(10) Patent No.: US 7,655,175 B2
(45) Date of Patent: Feb. 2, 2010

(54) ROTARY SPINNING PROCESSES FOR FORMING HYDROXYL POLYMER-CONTAINING FIBERS

(75) Inventors: John Gerhard Michael, Cincinnati, OH (US); Stanford Royce Jackson, Fairfield, OH (US); Michael David James, Cincinnati, OH (US); Hasan Eroglu, West Chester, OH (US); Savas Aydore, West Chester, OH (US); Edwin Arthur Stewart, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 795 days.

(21) Appl. No.: 11/016,522

(22) Filed: Dec. 17, 2004

(65) Prior Publication Data

US 2005/0136253 A1 Jun. 23, 2005

Related U.S. Application Data

(60) Provisional application No. 60/530,534, filed on Dec. 18, 2003.

(51) Int. Cl.

| | |
|---|---|
| ***D01D 5/12*** | (2006.01) |
| ***D01D 5/18*** | (2006.01) |
| ***D01D 5/30*** | (2006.01) |
| ***D01D 10/02*** | (2006.01) |
| ***D06M 10/02*** | (2006.01) |

(52) U.S. Cl. ..... 264/465; 264/172.12; 264/172.14; 264/172.15; 264/211; 264/211.1; 264/211.11; 264/211.12; 264/211.14; 264/211.17; 264/236; 264/555

(58) Field of Classification Search ..... 264/172.13, 264/172.14, 172.15, 211, 211.1, 211.12, 264/211.14, 211.17, 465, 555, 236, 211.11
See application file for complete search history.

(56) References Cited

U.S. PATENT DOCUMENTS

| | | | | |
|---|---|---|---|---|
| 2,169,250 | A | | 8/1939 | Izard |
| 3,824,136 | A | | 7/1974 | Ellis |
| 4,178,336 | A | | 12/1979 | Snowden |
| 4,197,063 | A | | 4/1980 | Davidson |
| 4,323,524 | A | | 4/1982 | Snowden |
| 4,350,006 | A | * | 9/1982 | Okamoto et al. .... 264/172.13 X |
| 4,418,026 | A | | 11/1983 | Blackie et al. |
| 4,790,736 | A | | 12/1988 | Keuchel |
| 5,009,954 | A | | 4/1991 | Collier et al. |
| 5,494,616 | A | | 2/1996 | Voelker et al. |
| 5,702,658 | A | | 12/1997 | Pellegrin et al. |
| 5,779,760 | A | | 7/1998 | Watton et al. |
| 5,972,501 | A | | 10/1999 | Ohmory et al. |
| 6,045,908 | A | | 4/2000 | Nakajima et al. |
| 6,136,244 | A | | 10/2000 | Rusticus et al. |
| 6,214,143 | B1 | | 4/2001 | Robertson et al. |

(Continued)

FOREIGN PATENT DOCUMENTS

| | | |
|---|---|---|
| GB | 1 523 495 | 9/1978 |

(Continued)

*Primary Examiner*—Leo B Tentoni
(74) *Attorney, Agent, or Firm*—C. Brant Cook

(57) ABSTRACT

Rotary spinning processes, more particularly processes for making hydroxyl polymer-containing fibers using a rotary spinning die, hydroxyl polymer-containing fibers made by the processes and webs made with the hydroxyl polymer-containing fibers are provided.

22 Claims, 4 Drawing Sheets

U.S. PATENT DOCUMENTS

| | | | | |
|---|---|---|---|---|
| 6,221,487 | B1 | 4/2001 | Luo et al. | |
| 6,235,392 | B1 * | 5/2001 | Luo et al. | 264/211.11 X |
| 6,709,526 | B1 | 3/2004 | Bailey et al. | |
| 2002/0028857 | A1 * | 3/2002 | Holy | 523/124 |
| 2002/0148050 | A1 | 10/2002 | Luo et al. | |
| 2004/0249066 | A1 * | 12/2004 | Heinzman et al. | 525/54.3 |

FOREIGN PATENT DOCUMENTS

| | | |
|---|---|---|
| WO | WO 97/30196 | 8/1997 |
| WO | WO 98/07911 | 2/1998 |
| WO | WO 01/86043 | 11/2001 |
| WO | WO 2004/074367 A1 | 9/2004 |
| WO | WO 2004/108832 | 12/2004 |

* cited by examiner

ROTARY SPINNING PROCESSES FOR FORMING HYDROXYL POLYMER-CONTAINING FIBERS

CROSS REFERENCE TO RELATED APPLICATIONS

This application claims the benefit of U.S. Provisional Application No. 60/530,534 filed Dec. 18, 2003.

FIELD OF THE INVENTION

The present invention relates to rotary spinning processes for forming hydroxyl polymer-containing fibers, more particularly to processes for making hydroxyl polymer-containing fibers using a rotary spinning die, hydroxyl polymer-containing fibers made by such rotary spinning processes and webs made with such hydroxyl polymer-containing fibers.

BACKGROUND OF THE INVENTION

Non-rotary spinning processes for making fibers such as those using knife-edge dies and/or spunbond dies and/or melt blown dies are known in the art.

Rotary spinning processes for making fibers that do not contain hydroxyl polymers are also known in the art. For example it is known that fiberglass material fibers can be formed by rotary spinning processes. However, the prior art fails to teach or suggest rotary spinning processes for making hydroxyl polymer-containing fibers, especially hydroxyl polymer-containing fibers that exhibit wet strength properties and/or solubility properties that are suitable for consumer products.

Accordingly, there is a need for rotary spinning processes for making hydroxyl polymer-containing fibers.

SUMMARY OF THE INVENTION

The present invention fulfills the need described above by providing rotary spinning processes for making hydroxyl polymer-containing fibers.

In one example of the present invention, a process for making hydroxyl polymer-containing fibers, the process comprising the step of subjecting a hydroxyl polymer-containing composition to a rotary spinning process such that a hydroxyl polymer-containing fiber is formed.

In another example of the present invention, a process for making hydroxyl polymer-containing fibers, the process comprising the steps of:

a. providing a hydroxyl polymer-containing composition;
b. supplying a rotary spinning die with the hydroxyl polymer-containing composition; and
c. operating the rotary spinning die such that the hydroxyl polymer-containing composition exits the rotary spinning die as one or more hydroxyl polymer-containing fibers, is provided.

In even another example of the present invention, a hydroxyl polymer-containing fiber produced by a process of the present invention is provided.

In yet another example of the present invention, a web comprising a hydroxyl polymer-containing fiber produced according to the present invention is provided.

In even yet another example of the present invention, a process for making one or more hydroxyl polymer-containing fibers, the process comprising the step of subjecting a hydroxyl polymer-containing composition to a rotary spinning process such that one or more hydroxyl polymer-containing fibers are produced, is provided.

In still yet another example of the present invention, a process for making one or more hydroxyl polymer-containing fibers, the process comprising the steps of:

a. providing a first composition comprising a first material;
b. providing a second composition comprising a second material;
c. supplying a rotary spinning die with the first and second compositions; and
d. operating the rotary spinning die such that the first and second compositions exit the rotary spinning die as one or more multi-component fibers;

wherein at least one of the first material and second material comprises a hydroxyl polymer, is provided.

Accordingly, the present invention provides processes for making hydroxyl polymer-containing fibers, hydroxyl polymer-containing fibers produced by such processes and webs comprising such hydroxyl polymer-containing fibers.

DETAILED DESCRIPTION OF THE INVENTION

Definitions

Figure 1:
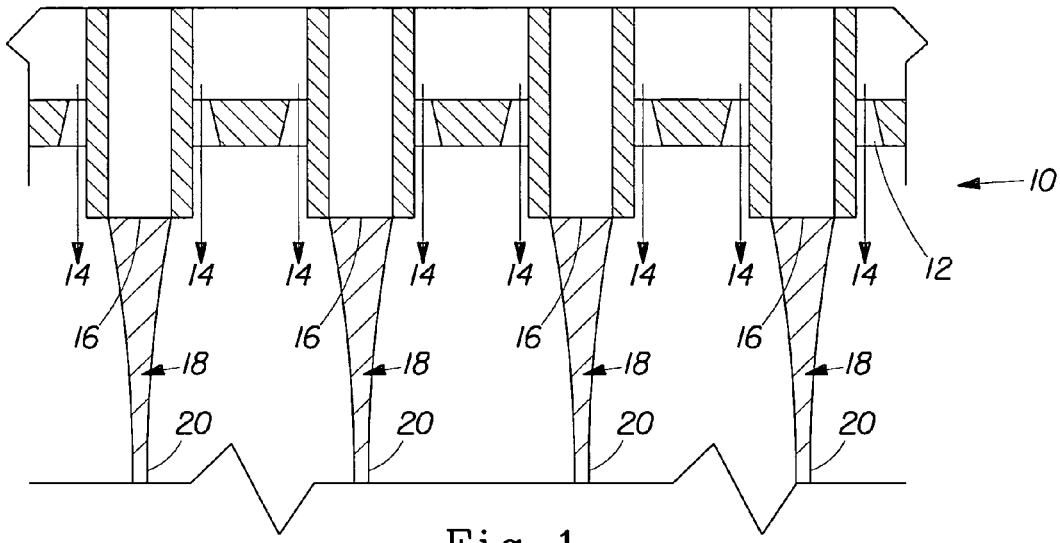
FIG. 1 is a schematic representation of a non-rotary spinning process for making hydroxyl polymer-containing fibers.

"Non-rotary spinning process" as used herein means a process wherein a hydroxyl polymer-containing fiber is formed from a hydroxyl polymer-containing composition as the hydroxyl polymer-containing composition exits a non-rotary spinning die. The hydroxyl polymer-containing composition is formed into a hydroxyl polymer-containing fiber as a result of attenuation of the hydroxyl polymer-containing composition via an attenuating fluid stream and/or gravitational forces and/or mechanical forces and/or electrical forces as the hydroxyl polymer-containing composition exits the non-rotary spinning die. FIG. 1 is a schematic representation of a non-rotary spinning process for making hydroxyl polymer-containing fibers. As shown in FIG. 1, a non-rotary spinning die 10 comprises an attenuating fluid stream opening 12 through which an attenuating fluid stream 14 exits the die 10 and a hydroxyl polymer-containing composition opening 16 through which a hydroxyl polymer-containing composition 18 exits the die 10 and is attenuated into the form of a hydroxyl polymer-containing fiber 20 solely as a result of the attenuating fluid stream 14.

Figure 2A:
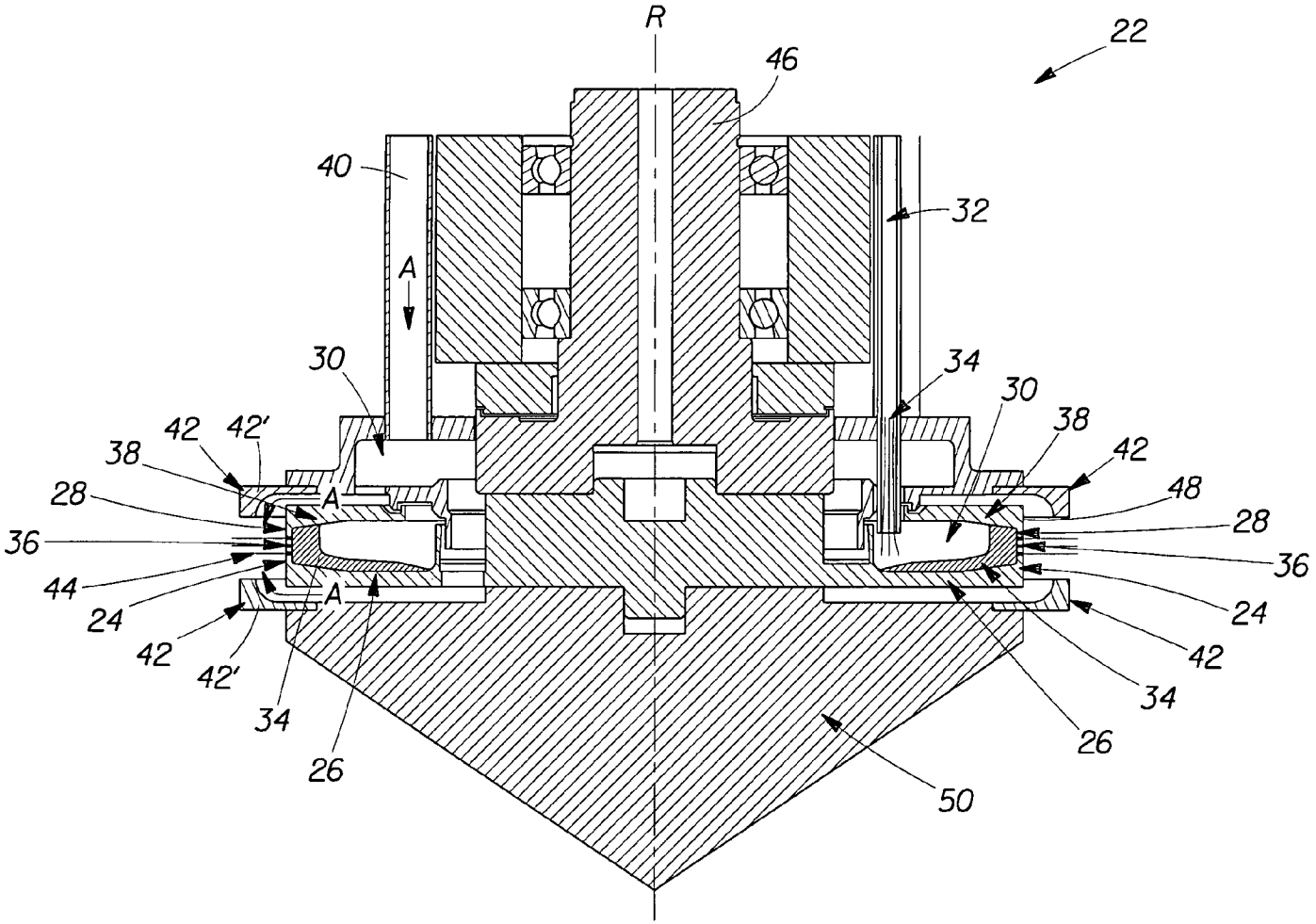
FIG. 2A is a schematic representation of one example of a rotary spinning process for making hydroxyl polymer-containing fibers in accordance with the present invention.
Figure 2B:
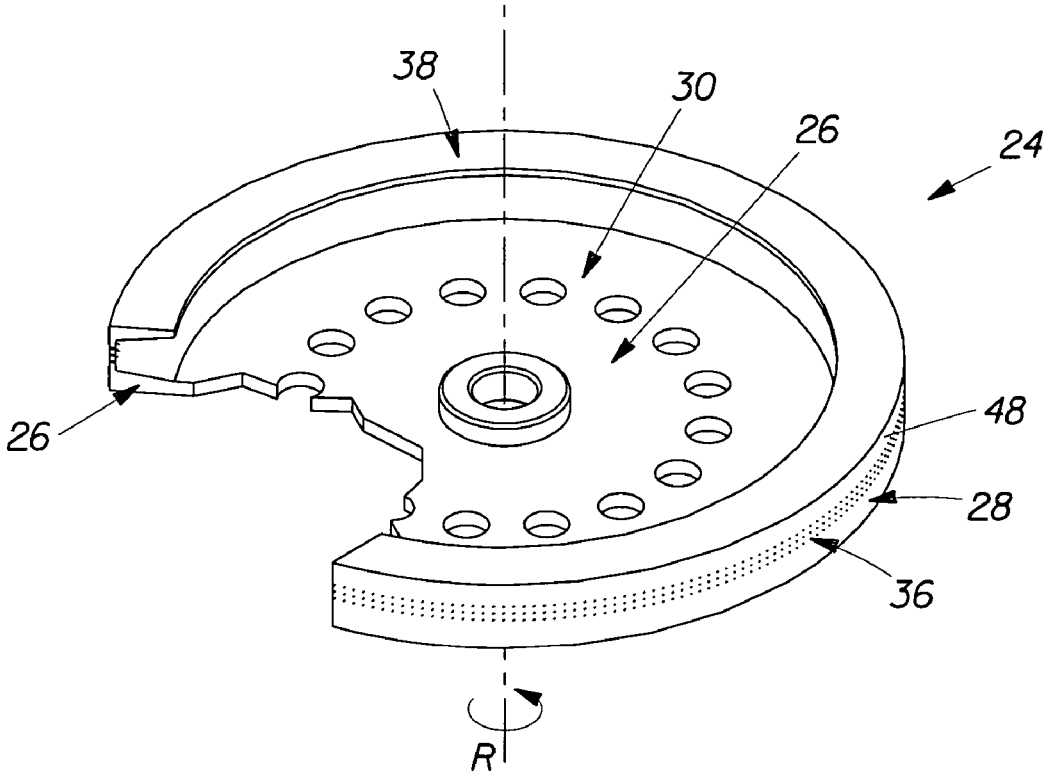
FIG. 2B is a schematic representation of one example of a rotary spinning die, which is a part of FIG. 2A, for making hydroxyl polymer-containing fibers in accordance with the present invention.

"Rotary spinning process" as used herein means a process wherein a non hydroxyl polymer-containing fiber is formed from a hydroxyl polymer-containing composition as the hydroxyl polymer-containing composition exits a rotary spinning die. The hydroxyl polymer-containing composition is formed into a hydroxyl polymer-containing fiber as a result of attenuation of the hydroxyl polymer-containing composition by an attenuation force other than solely an attenuating fluid stream and/or gravitational forces and/or mechanical forces and/or electrical forces as the hydroxyl polymer-containing composition exits the rotary spinning die. FIGS. 2A and 2B are schematic representations of one example of a rotary spinning process for making hydroxyl polymer-containing fibers.

"Attenuating fluid stream" as used herein means a discrete fluid stream that imparts acceleration to the hydroxyl polymer-containing composition preferably such that the hydroxyl polymer-containing composition is drawn into a hydroxyl polymer-containing fiber.

"Discrete fluid stream" as used herein means one or more gases, such as air, that exhibits sufficient velocity and proximity to the hydroxyl polymer-containing composition such that the hydroxyl polymer-containing composition is accelerated by the one or more gases.

"Fiber" or "filament" as used herein means a slender, thin, and highly flexible object having a major axis which is very long, compared to the fiber's two mutually-orthogonal axes that are perpendicular to the major axis. Preferably, an aspect ratio of the major's axis length to an equivalent diameter of the fiber's cross-section perpendicular to the major axis is greater than 100/1, more specifically greater than 500/1, and still more specifically greater than 1000/1, and even more specifically, greater than 5000/1. The fibers may be continuous or substantially continuous fibers or they may be discontinuous fibers.

The fibers of the present invention may have a fiber diameter of less than about 50 microns and/or less than about 20 microns and/or less than about 10 microns and/or less than about 8 microns and/or less than about 6 microns and/or less than about 4 microns as measured by the Fiber Diameter Test Method described herein.

"Spinning process temperature" as used herein means the temperature at which the hydroxyl polymer-containing fibers are attenuated at the external surface of the rotary spinning die as the hydroxyl polymer-containing fibers are formed.

"Hydroxyl polymer-containing composition" as used herein means a composition that comprises at least one hydroxyl polymer. In one example, the hydroxyl polymer-containing composition comprises at least one material that doesn't melt before it decomposes. For example, a hydroxyl polymer can dissolve in water, rather than melt, and then can be dried (removal of water) during a fiber forming process.

Hydroxyl Polymer-Containing Composition

The hydroxyl polymer-containing composition comprises a hydroxyl polymer. "Hydroxyl polymer" as used herein mean any polymer that contains greater than 10% and/or greater than 20% and/or greater than 25% by weight hydroxyl groups.

The hydroxyl polymer-containing composition may be a composite containing a blend of polymers, wherein at least one is a hydroxyl polymer, and/or fillers both inorganic and organic, and/or fibers and/or foaming agents.

The hydroxyl polymer-containing composition may already be formed. In one example, the hydroxyl polymer may be solubilized via contact with a liquid, such as water, in order to form the hydroxyl polymer-containing composition. Such a liquid may be considered for the purposes of the present invention as performing the function of an external plasticizer. Alternatively, any other suitable processes known to those skilled in the art to produce the hydroxyl polymer-containing composition such that the hydroxyl polymer-containing composition exhibits suitable properties for spinning the composition into a fiber may be used.

The hydroxyl polymer-containing composition may have and/or be exposed to a temperature of from about 23° C. to about 100° C. and/or from about 65° C. to about 95° C. and/or from about 70° C. to about 90° C. when making fibers from the hydroxyl polymer-containing composition.

The pH of the hydroxyl polymer-containing composition may be from about 2.5 to about 9 and/or from about 3 to about 8.5 and/or from about 3.2 to about 8 and/or from about 3.2 to about 7.5.

The hydroxyl polymer-containing composition may have a shear viscosity, as measured according to the Shear Viscosity of a Hydroxyl Polymer-Containing Composition Test Method described herein, of less than about 300 Pa·s and/or from about 0.1 Pa·s to about 300 Pa·s and/or from about 1 Pa·s to about 250 Pa·s and/or from about 3 Pa·s to about 200 Pa·s as measured at a shear rate of 3,000 $sec^{-1}$ at the spinning process temperature.

In one example, a hydroxyl polymer-containing composition of the present invention may comprise at least about 5% and/or 15% and/or from at least about 20% and/or 30% and/or 40% and/or 45% and/or 50% to about 75% and/or 80% and/or 85% and/or 90% and/or 95% and/or 99.5% by weight of the hydroxyl polymer-containing composition of a hydroxyl polymer. The hydroxyl polymer may have a weight average molecular weight greater than about 100,000 g/mol prior to crosslinking.

A crosslinking system may be present in the hydroxyl polymer-containing composition and/or may be added to the hydroxyl polymer-containing composition before polymer processing of the hydroxyl polymer-containing composition.

The hydroxyl polymer-containing composition may comprise a) at least about 5% and/or 15% and/or from at least about 20% and/or 30% and/or 40% and/or 45% and/or 50% to about 75% and/or 80% and/or 85% by weight of the hydroxyl polymer-containing composition of a hydroxyl polymer; b) a crosslinking system comprising from about 0.1% to about 10% by weight of the hydroxyl polymer-containing composition of a crosslinking agent; and c) from about 10% and/or 15% and/or 20% to about 50% and/or 55% and/or 60% and/or 70% by weight of the hydroxyl polymer-containing composition of external plasticizer e.g., water.

Synthesis of Hydroxyl Polymer-Containing Composition

A hydroxyl polymer-containing composition of the present invention may be prepared using a screw extruder, such as a vented twin screw extruder.

Figure 3A:
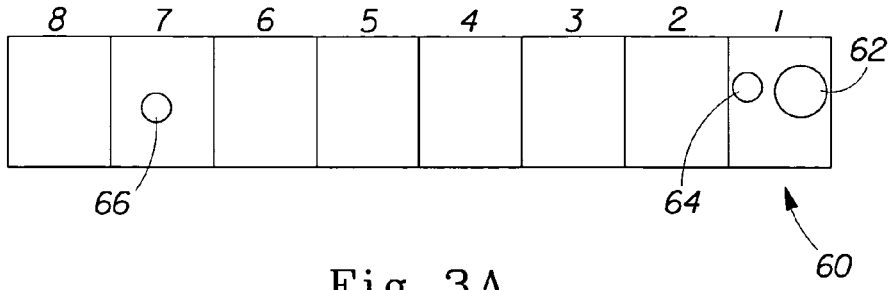
FIG. 3A is a schematic side view of a barrel of a twin screw extruder suitable for use in preparing the hydroxyl polymer-containing composition of the present invention.

A barrel 60 of an APV Baker (Peterborough, England) twin screw extruder is schematically illustrated in FIG. 3A. The barrel 60 is separated into eight zones, identified as zones 1-8. The barrel 60 encloses the extrusion screw and mixing elements, schematically shown in FIG. 3B, and serves as a containment vessel during the extrusion process. A solid feed port 62 is disposed in zone 1 and a liquid feed port 64 is disposed in zone 1. A vent 66 is included in zone 7 for cooling and decreasing the liquid, such as water, content of the mixture prior to exiting the extruder. An optional vent stuffer, commercially available from APV Baker, can be employed to prevent the hydroxyl polymer-containing composition from exiting through the vent 66. The flow of the hydroxyl polymer-containing composition through the barrel 60 is from zone 1 exiting the barrel 60 at zone 8.

Figure 3B:
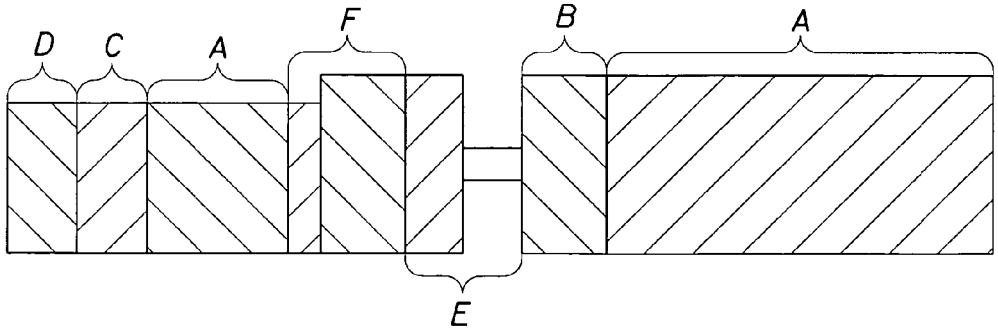
FIG. 3B is a schematic side view of a screw and mixing element configuration suitable for use in the barrel of FIG. 1A.

A screw and mixing element configuration for the twin screw extruder is schematically illustrated in FIG. 3B. The twin screw extruder comprises a plurality of twin lead screws (TLS) (designated A and B) and single lead screws (SLS) (designated C and D) installed in series. Screw elements (A-D) are characterized by the number of continuous leads and the pitch of these leads.

A lead is a flight (at a given helix angle) that wraps the core of the screw element. The number of leads indicates the number of flights wrapping the core at any given location along the length of the screw. Increasing the number of leads reduces the volumetric capacity of the screw and increases the pressure generating capability of the screw.

The pitch of the screw is the distance needed for a flight to complete one revolution of the core. It is expressed as the number of screw element diameters per one complete revolution of a flight. Decreasing the pitch of the screw increases the pressure generated by the screw and decreases the volumetric capacity of the screw.

The length of a screw element is reported as the ratio of length of the element divided by the diameter of the element.

This example uses TLS and SLS. Screw element A is a TLS with a 1.0 pitch and a 1.5 length ratio. Screw element B is a TLS with a 1.0 pitch and a 1.0 L/D ratio. Screw element C is a SLS with a ¼ pitch and a 1.0 length ratio. Screw element D is a SLS and a ¼ pitch and a ½ length ratio.

Bilobal paddles, E, serving as mixing elements, are also included in series with the SLS and TLS screw elements in order to enhance mixing. Various configurations of bilobal paddles and reversing elements F, single and twin lead screws threaded in the opposite direction, are used in order to control flow and corresponding mixing time.

In zone 1, the hydroxyl polymer is fed into the solid feed port at a rate of 230 grams/minute using a K-Tron (Pitman, N.J.) loss-in-weight feeder. This hydroxyl polymer is combined inside the extruder (zone 1) with water, an external plasticizer, added at the liquid feed at a rate of 146 grams/minute using a Milton Roy (Ivyland, Pa.) diaphragm pump (1.9 gallon per hour pump head) to form a hydroxyl polymer/water slurry. This slurry is then conveyed down the barrel of the extruder and cooked. Table 1 describes the temperature, pressure, and corresponding function of each zone of the extruder.

TABLE I

| Zone | Temp.(° F.) | Pressure | Description of Screw | Purpose |
|---|---|---|---|---|
| 1 | 70 | Low | Feeding/ Conveying | Feeding and Mixing |
| 2 | 70 | Low | Conveying | Mixing and Conveying |
| 3 | 70 | Low | Conveying | Mixing and Conveying |
| 4 | 130 | Low | Pressure/ Decreased Conveying | Conveying and Heating |
| 5 | 300 | Medium | Pressure Generating | Cooking at Pressure and Temperature |
| 6 | 250 | High | Reversing | Cooking at Pressure and Temperature |
| 7 | 210 | Low | Conveying | Cooling and Conveying (with venting) |
| 8 | 210 | Low | Pressure Generating | Conveying |

After the slurry exits the extruder, part of the hydroxyl polymer/water slurry is dumped and another part (100 g) is fed into a Zenith®, type PEP II (Sanford N.C.) and pumped into a SMX style static mixer (Koch-Glitsch, Woodridge, Ill.). The static mixer is used to combine additional additives such as crosslinking agents, crosslinking facilitators, additional external plasticizers, such as additional water or other external plasticizers, with the hydroxyl polymer/water slurry to form a hydroxyl polymer-containing composition. The additives are pumped into the static mixer via PREP 100 HPLC pumps (Chrom Tech, Apple Valley Minn.). These pumps provide high pressure, low volume addition capability. The hydroxyl polymer-containing composition of the present invention is ready to be spun into a hydroxyl polymer-containing fiber.

Spinning of a Fiber Using a Rotary Spinning Process

A nonlimiting example of a rotary spinning process for preparing a fiber comprising a hydroxyl polymer in accordance with the present invention follows. A hydroxyl polymer-containing composition is prepared according to the Synthesis of a Hydroxyl Polymer-Containing Composition described above. As shown in FIG. 4, the hydroxyl polymer-containing composition may be spun into a hydroxyl polymer-containing fiber via a rotary spinning process (or a rotary polymer processing operation). "Polymer processing" as used herein means any operation and/or process by which a fiber comprising a hydroxyl polymer is formed from a hydroxyl polymer-containing composition.

As shown in FIGS. 2A and 2B, in one example of a rotary spinning system 22 in accordance with the present invention, the rotary spinning system 22 may comprise a rotary spinning die 24 comprising a bottom wall 26 and an outer annular wall 28. The bottom wall 26 and the outer annular wall 28 are associated with each other such that a receiving compartment 30 is defined. The rotary spinning system 22 further comprises a hydroxyl polymer-containing composition source 32 which is in fluid communication with the receiving compartment 30. The hydroxyl polymer-containing composition source 32 is capable of delivering a hydroxyl polymer-containing composition 34 to the receiving compartment 30.

The outer annular wall 28 comprises at least one hole 36 through which the hydroxyl polymer-containing composition 34 can exit the rotary spinning die 24 during operation. The rotary spinning die 24 may further comprise a top wall 38 that is associated with the outer annular wall 28 to further define the receiving compartment 30. The rotary spinning system 22 may further comprise a humid air source 40 which is capable of delivering humid air, as represented by the arrow A into and/or around the rotary spinning die 24.

The bottom wall 26 may comprise channels and/or grooves (not shown) that facilitate and/or aid the movement of the hydroxyl polymer-containing composition 34 within the receiving compartment 30.

The rotary spinning system 22 may comprise an air deflector 42 which guides the humid air A. In one example, the air deflector 42 is attached to the rotary spinning die 24. In another example, the air deflector 42 is separate and discrete from the rotary spinning die 24. In still another example, the air deflector 42 comprises an upper hood 42' and a lower hood 42", wherein one of the upper hood 42' and the lower hood 42" is attached to the rotary spinning die 24 and the other is separate and discrete from the rotary spinning die 24.

The air deflector 42 is capable of guiding humid air A such that the humid air A contacts fibers 44 that are exiting the holes 36 of the outer annular wall 28.

The humid air A may humidify the hydroxyl polymer-containing composition 34 and/or the hydroxyl polymer-containing fibers 44. The humid air A may exhibit a relative humidity of greater than 50% and/or greater than 60% and/or greater than 70%. In one example, the humid air A is supplied to an area adjacent to the outer annular wall 28 of the rotary spinning die 24. In another example, the humid air A is supplied through openings (not shown) in the outer annular wall 28 adjacent to the holes 36. Nonlimiting examples of such openings include pores or slots, that are capable of providing humid air adjacent to one or more fibers 44 exiting the rotary spinning die 24.

The air deflectors 42 may, in addition to guiding the humid air A, minimize the amount of non-humidified air from contacting the rotary spinning die 24 and/or the fibers 44.

The addition of humid air A to the die interior may reduce the tendency of the hydroxyl polymer-containing composition 34 from prematurely drying to an extent that it does not easily flow through the holes 36 of the rotary spinning die 24. The humid air A may maintain the hydroxyl polymer-containing composition 34 in a fluid state such that it flows freely through the holes 36 of the rotary spinning die 24.

The rotary spinning system 22 may further comprise a mounting system 46 which is capable of releasably receiving and/or permanently receiving the rotary spinning die 24. The mounting system 46 may be associated with a drive motor or other device capable of rotating the mounting system 46 and thus the rotary spinning die 24 during operation radially about the axis R.

During operation of the rotary spinning system 22, the rotary spinning die 24, as it revolves around axis R, imparts inertia to the hydroxyl polymer-containing composition 34, which is present in the receiving compartment 30 and in contact with a wall of the rotary spinning die 24. The hydroxyl polymer-containing composition 34 come into contact with the outer annular wall 28 and accumulate temporarily before exiting the rotary spinning die 24 through at least one hole 36 in the outer annular wall 28. As a result of the inertia imparted to the hydroxyl polymer-containing composition 28 and as a result of the hydroxyl polymer-containing composition 34 exiting the rotary spinning die 24 through at least one hole 36, the hydroxyl polymer-containing composition 34 is attenuated into one or more fibers 44. As a result of the inertia imparted to the hydroxyl polymer-containing composition 34, attenuating fluid stream is necessary to attenuate the hydroxyl polymer-containing composition 34 into fibers 44. However, in another example, an attenuation fluid stream may also be applied to the hydroxyl polymer-containing composition 34 to additionally aid the attenuation of the hydroxyl polymer-containing composition 34 into hydroxyl polymer-containing fibers 44.

The feeding/supplying of a hydroxyl polymer-containing composition 34 to the rotary spinning die 24 can be a batch and/or a continuous process. In one example, the hydroxyl polymer-containing composition 34 is supplied to the rotary spinning die 24 by a continuous or semi-continuous process. The rotary spinning die 24 may or may not be revolving at the time the hydroxyl polymer-containing composition 34 is being supplied to the rotary spinning die 24.

The hydroxyl polymer-containing fibers 44 may be collected on a collection device (not shown) in order to form a web. In one example, a vacuum can be used to facilitate collection of the fibers 44 onto the collection device. In addition, the fibers 44 may be collected on the collection device in a uniform manner.

The diameter of the rotary spinning die 24 may be such that its outer annular wall's exterior surface 48 exhibits a tip velocity of from about 1 m/s to about 300 m/s and/or from about 10 m/s to about 200 m/s and/or from about 10 m/s to about 100 m/s during operation.

The at least one hole 36 of the outer annular wall 28 may be configured to provide a throughput of hydroxyl polymer-containing composition 34 of from about 0.1 to about 10 grams/hole/minute ("ghm") and/or from about 0.2 to about 10 ghm and/or from about 0.3 to about 8 ghm. The grams/hole/minute can be thought of as grams/fiber generating stream/minute for rotary spinning die examples, such as a disc that has no outer annular wall with holes through which the hydroxyl polymer-containing composition exits the rotary spinning die, examples of which are described below.

The rotary spinning die may be a disc having a surface upon which the hydroxyl polymer-containing composition may come into contact with prior to exiting the disc in the form of fibers. The disc may be relatively smooth or be designed and/or modified to include grooves and/or recesses to control the path of movement of the hydroxyl polymer-containing composition as it moves to exit the disc.

In yet another example, the rotary spinning die may be a drum or barrel having a surface upon which the hydroxyl polymer-containing composition may come into contact with prior to exiting the drum or barrel in the form of fibers. Like the disc, the drum or barrel may be relatively smooth or be designed and/or modified to include grooves and/or recesses to control the path of movement of the hydroxyl polymer-containing composition as it moves to exit the drum or barrel.

In general, the rotary spinning die can be any surface that is capable of moving, such as rotating, such that as a hydroxyl polymer-containing composition contacts the surface and subsequently exits the surface a hydroxyl polymer-containing fiber is formed.

Even though FIGS. 2A and 2B represent one example of a rotary spinning system 22 with a rotary spinning die 24 that produces hydroxyl polymer-containing fibers 44 in a perpendicular manner relative to axis R about which the rotary spinning die 24 revolves, hydroxyl polymer-containing fibers 44 can be produced from the rotary spinning die 24 in a parallel manner relative to axis R and/or in any other directional manner relative to axis R.

In another example, a drying air system (not shown), which may be capable of providing drying air at a drying air temperature of greater than about 100° C. at a relative humidity of less than about 50% and/or less than about 40% and/or less than about 30% and/or less than about 20% to dry the hydroxyl polymer-containing fibers 44 can be employed in conjunction with the rotary spinning die 24. The drying air temperature may contact the hydroxyl polymer-containing fiber 44 at least about 5 mm and/or at least about 7 mm and/or at least about 10 mm radially from the outer annular wall's exterior surface 48. The drying air can be directed around the rotary spinning die 24 via slots, pore or other directing means. The drying air can be positioned relative to the rotary spinning die such that the drying air mixes with the hydroxyl polymer-containing fibers during and/or after attenuation of the fibers has occurred at a controlled radial distance from the outer annular wall's exterior surface 48. By proper choice of drying air placement, a low drying region can be maintained near the outer annular wall's exterior surface 48, while a high drying region can be maintained at greater radial distances from the outer annular wall's exterior surface 48. The drying air system can aid in attenuating the hydroxyl polymer-containing fibers 44 if desired.

Drying air, when used, may be at a temperature below about 100° C. depending upon the relative humidity of the drying air.

Further, a heating system (not shown) can be employed in conjunction with the rotary spinning die 24 to heat the hydroxyl polymer-containing composition 36. The hydroxyl polymer-containing composition 36 may exhibit a temperature of greater than or equal to about 23° C. to less than or equal to about 100° C.

In another example, an inverted cone 50 can be mounted to the bottom wall 26 of the rotary spinning die 24 to minimize hydroxyl polymer-containing fibers 44 from being drawn towards the center of the bottom wall 26 of the rotary spinning die 24.

In another example, an electrical charge system (not shown), such as is used in electrospinning process, may be employed in conjunction with the rotary spinning die 24.

In another example, the rotary spinning die can be designed to process two or more different types of materials and/or compositions at the same time, where at least one material or composition is a hydroxyl polymer or a hydroxyl polymer-containing composition. The multiple materials may be made to contact one another yielding composite fibers, or they may be maintained as separate fibers. If the materials contact one another, the contact may yield fibers possibly covering a range of structures. One material may entirely enclose another material along the length of the fiber, often referred to as sheath/core fibers. Alternatively, the materials may be more simply adjacent to one another, yielding side-by-side fibers. Such side-by-side fibers may not be continuous in all material streams, yielding discontinuous multi-component fibers.

In still another example, an attenuation air system (not shown) may be employed in conjunction with the rotary spinning die 24 to aid in the attenuation of the hydroxyl polymer-containing fibers 44 via an attenuating fluid stream.

In one example, the rotary spinning process may be operated at a capillary number of greater than 1 and/or greater than 4. Capillary number is discussed in greater detail below.

In one example, the hydroxyl polymer-containing fiber of the present invention may be cured at a curing temperature of from about 70° C. to about 200° C. and/or from about 110° C. to about 195° C. and/or from about 130° C. to about 185° C. for a time period of from about 0.01 and/or 1 and/or 5 and/or 15 seconds to about 60 minutes and/or from about 20 seconds to about 45 minutes and/or from about 30 seconds to about 30 minutes. Alternative curing methods may include radiation methods such as UV, e-beam, IR, convection heating and other temperature-raising methods and combinations thereof.

Further, the fiber may also be cured at room temperature for days, either after curing at above room temperature or instead of curing at above room temperature.

In another example, the fibers of the present invention may include a multiconstituent fiber, such as a multicomponent fiber. A multicomponent fiber, as used herein, means a fiber having more than one separate part in spatial relationship to one another. Multicomponent fibers include bicomponent fibers, which are defined as fibers having two separate parts in a spatial relationship to one another. The different components of multicomponent fibers can be arranged in substantially distinct regions across the cross-section of the fiber and extend continuously along the length of the fiber. The different components of the multicomponent fiber can be similar in composition, such as a first modified starch and a second, differently modified starch. Alternatively, the different components may, for example, exhibit different properties, such as a hydroxyl polymer-containing and a thermoplastic material and/or a hydrophobic material and a hydrophilic material.

The multicomponent fibers may be formed in different orientations, such as a core/sheath orientation, a side-by-side orientation and/or a continuous fiber of a first component having discontinuous regions of a different component dispersed within the first component.

A nonlimiting example of such a multicomponent fiber, specifically a bicomponent fiber, is a bicomponent fiber in which the hydroxyl polymer of the present invention represents the core of the fiber and another polymer represents the sheath, which surrounds or substantially surrounds the core of the fiber. The hydroxyl polymer-containing composition from which such a fiber is derived may include both the hydroxyl polymer and the other polymer.

In another multicomponent, especially bicomponent fiber example, the sheath may comprise a hydroxyl polymer and a crosslinking system having a crosslinking agent, and the core may comprise a hydroxyl polymer and a crosslinking system having a crosslinking agent. With respect to the sheath and core, the hydroxyl polymer may be the same or different and the crosslinking agent may be the same or different. Further, the level of hydroxyl polymer may be the same or different and the level of crosslinking agent may be the same or different.

One or more fibers of the present invention may be incorporated into a fibrous structure and/or web. Such a fibrous structure may ultimately be incorporated into a commercial product, such as a single- or multi-ply sanitary tissue product, such as facial tissue, bath tissue, paper towels and/or wipes, feminine care products, diapers, writing papers, cores, such as tissue cores, and other types of paper products.

Hydroxyl Polymers

Hydroxyl polymers in accordance with the present invention include any hydroxyl-containing polymer that can be incorporated into a fiber of the present invention. In one example, the hydroxyl-containing polymer does not include unmodified, unsubstituted cellulose polymers, such as lyocell.

In one example, the hydroxyl polymer of the present invention includes greater than 10% and/or greater than 20% and/or greater than 25% by weight hydroxyl moieties.

Nonlimiting examples of hydroxyl polymers in accordance with the present invention include polyols, such as starch and starch derivatives, cellulose derivatives such as cellulose ether and ester derivatives, chitosan and chitosan derivatives, polyvinylalcohols and various other polysaccharides such as gums, arabinans and galactans, and proteins.

The hydroxyl polymer preferably has a weight average molecular weight of greater than about 10,000 g/mol and/or greater than about 40,000 g/mol and/or from about 10,000 to about 80,000,000 g/mol and/or from about 10,000 to about 40,000,000 g/mol and/or from about 10,000 to about 10,000,000 g/mol. Higher and lower molecular weight hydroxyl polymers may be used in combination with hydroxyl polymers having the preferred weight average molecular weight. "Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

A natural starch can be modified chemically or enzymatically, as well known in the art. For example, the natural starch can be acid-thinned, hydroxy-ethylated or hydroxy-propylated or oxidized.

"Polysaccharides" herein means natural polysaccharides and polysaccharide derivatives or modified polysaccharides. Suitable polysaccharides include, but are not limited to, gums, arabinans, galactans and mixtures thereof.

Polyvinylalcohols which are suitable for use as the hydroxyl polymers (alone or in combination) of the present invention can be characterized by the following general formula:

Structure IV

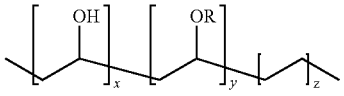

each R is selected from the group consisting of $C_1$-$C_4$ alkyl; $C_1$-$C_4$ acyl; and x/x+y+z=0.5-1.0.

Crosslinking System

The crosslinking system of the present invention may comprise, in addition to the crosslinking agent, a crosslinking facilitator.

"Crosslinking facilitator" as used herein means any material that is capable of activating a crosslinking agent thereby transforming the crosslinking agent from its unactivated state to its activated state such that the hydroxyl polymer is crosslinked via the crosslinking agent.

Nonlimiting examples of suitable crosslinking facilitators include acids having a pKa of between 2 and 6 or salts thereof. The crosslinking facilitators may be Bronsted Acids and/or salts thereof, preferably ammonium salts thereof.

In addition, metal salts, such as magnesium and zinc salts, can be used alone or in combination with Bronsted Acids and/or salts thereof, as crosslinking facilitators.

Nonlimiting examples of suitable crosslinking facilitators include acetic acid, benzoic acid, citric acid, formic acid, glycolic acid, lactic acid, maleic acid, phthalic acid, phosphoric acid, succinic acid and mixtures thereof and/or their salts, preferably their ammonium salts, such as ammonium glycolate, ammonium citrate and ammonium sulfate.

Nonlimiting examples of suitable crosslinking agents include compounds resulting from alkyl substituted or unsubstituted cyclic adducts of glyoxal with ureas (Structure V, X=O), thioureas (Structure V, X=S), guanidines (Structure V, X=NH, N-alkyl), methylene diamides (Structure VI), and methylene dicarbamates (Structure VII) and derivatives thereof; and mixtures thereof.

In one example, the crosslinking agent has the following structure:

Structure V

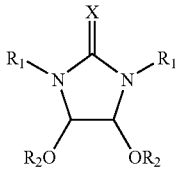

wherein X is O or S or NH or N-alkyl, and $R_1$ and $R_2$ are independently

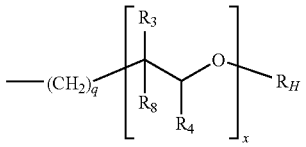

wherein $R_3$ and $R_8$ are independently selected from the group consisting of: H, linear or branched $C_1$-$C_4$ alkyl, $CH_2OH$ and mixtures thereof, $R_4$ is independently selected from the group consisting of: H, linear or branched $C_1$-$C_4$ alkyl, and mixtures thereof; x is 0-100; and q is 0-10, $R_H$ is independently selected from the group consisting of: H, linear or branched $C_1$-$C_4$ alkyl, and mixtures thereof.

In one example, $R_3$, $R_8$ and $R_4$ are not all $C_1$-$C_4$ alkyl in a single unit.

In yet another example, only one of $R_3$, $R_8$ and $R_4$ is $C_1$-$C_4$ alkyl in a single unit.

In another example, the crosslinking agent has the following structure:

Structure VI

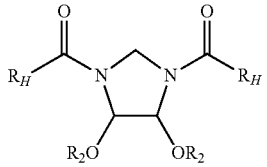

wherein $R_2$ is independently

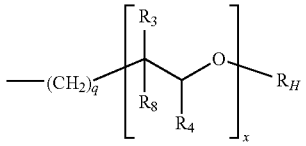

wherein $R_3$ and $R_8$ are independently selected from the group consisting of: H, linear or branched $C_1$-$C_4$ alkyl, $CH_2OH$ and mixtures thereof, $R_4$ is independently selected from the group consisting of: H, linear or branched $C_1$-$C_4$ alkyl, and mixtures thereof; x is 0-100; and q is 0-10, $R_H$ are independently selected from the group consisting of: H, linear or branched $C_1$-$C_4$ alkyl, and mixtures thereof.

In one example, $R_3$, $R_8$ and $R_4$ are not all $C_1$-$C_4$ alkyl in a single unit.

In yet another example, only one of $R_3$, $R_8$ and $R_4$ is $C_1$-$C_4$ alkyl in a single unit.

In still another example, the crosslinking agent has the following structure:

Structure VII

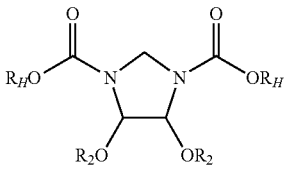

wherein $R_2$ is independently

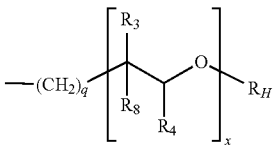

wherein $R_3$ and $R_8$ are independently selected from the group consisting of: H, linear or branched $C_1$-$C_4$ alkyl, $CH_2OH$ and mixtures thereof, $R_4$ is independently selected from the group consisting of: H, linear or branched $C_1$-$C_4$ alkyl, and mixtures thereof; x is 0-100; and q is 0-10, $R_H$ are independently selected from the group consisting of: H, linear or branched $C_1$-$C_4$ alkyl, and mixtures thereof.

In one example, $R_3$, $R_8$ and $R_4$ are not all $C_1$-$C_4$ alkyl in a single unit.

In yet another example, only one of $R_3$, $R_8$ and $R_4$ is $C_1$-$C_4$ alkyl in a single unit.

In yet other examples, the crosslinking agent has one of the following structures (Structure VIII, IX and X):

Structure VIII

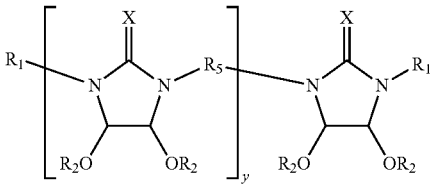

wherein X is O or S or NH or N-alkyl, and $R_1$ and $R_2$ are independently

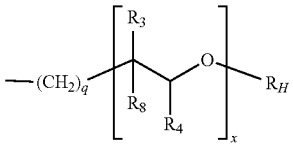

wherein $R_3$ and $R_8$ are independently selected from the group consisting of: H, linear or branched $C_1$-$C_4$ alkyl, $CH_2OH$ and mixtures thereof, $R_4$ is independently selected from the group consisting of: H, linear or branched $C_1$-$C_4$ alkyl, and mixtures thereof; x is 0-100; and q is 0-10, $R_H$ is independently selected from the group consisting of: H, linear or branched $C_1$-$C_4$ alkyl, and mixtures thereof; x is 0-100; y is 1-50; $R_5$ is independently selected from the group consisting of: $—(CH_2)_n—$ wherein n is 1-12, $—(CH_2CH(OH)CH_2)—$,

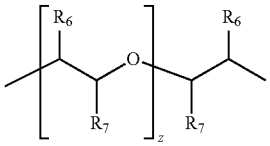

wherein $R_6$ and $R_7$ are independently selected from the group consisting of: H, linear or branched $C_1$-$C_4$ alkyl and mixtures thereof, wherein $R_6$ and $R_7$ cannot both be $C_1$-$C_4$ alkyl within a single unit; and z is 1-100.

In one example, $R_3$, $R_8$ and $R_4$ are not all $C_1$-$C_4$ alkyl in a single unit.

In yet another example, only one of $R_3$, $R_8$ and $R_4$ is $C_1$-$C_4$ alkyl in a single unit.

The crosslinking agent may have the following structure:

Structure IX

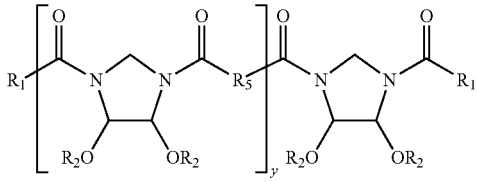

wherein $R_1$ and $R_2$ are independently

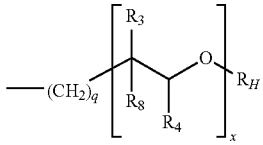

wherein $R_3$ and $R_8$ are independently selected from the group consisting of: H, linear or branched $C_1$-$C_4$ alkyl, $CH_2OH$ and mixtures thereof, $R_4$ is independently selected from the group consisting of: H, linear or branched $C_1$-$C_4$ alkyl, and mixtures thereof; x is 0-100; and q is 0-10, $R_H$ is independently selected from the group consisting of: H, linear or branched $C_1$-$C_4$ alkyl, and mixtures thereof; x is 1-100; y is 1-50; $R_5$ is independently $—(CH_2)_n—$ wherein n is 1-12.

In one example, $R_3$, $R_8$ and $R_4$ are not all $C_1$-$C_4$ alkyl in a single unit.

In yet another example, only one of $R_3$, $R_8$ and $R_4$ is $C_1$-$C_4$ alkyl in a single unit.

In even another example, the crosslinking agent has the following structure:

Structure X

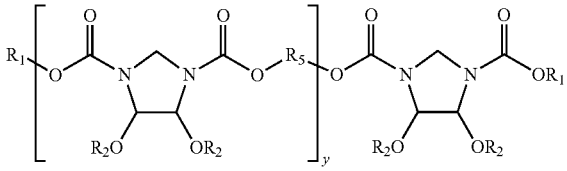

wherein $R_1$ and $R_2$ are independently

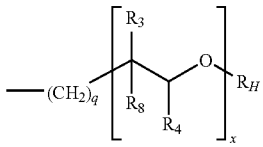

wherein $R_3$ and $R_8$ are independently selected from the group consisting of: H, linear or branched $C_1$-$C_4$ alkyl, $CH_2OH$ and mixtures thereof, $R_4$ is independently selected from the group consisting of: H, linear or branched $C_1$-$C_4$ alkyl, and mixtures thereof; x is 0-100; and q is 0-10, $R_H$ is independently selected from the group consisting of: H, linear or branched $C_1$-$C_4$ alkyl, and mixtures thereof; x is 1-100; y is 1-50; $R_5$ is independently selected from the group consisting of: —$(CH_2)_n$— wherein n is 1-12, —$(CH_2CH(OH)CH_2)$—,

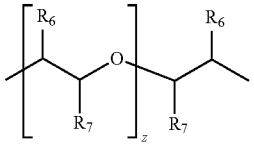

wherein $R_6$ and $R_7$ are independently selected from the group consisting of: H, linear or branched $C_1$-$C_4$ alkyl and mixtures thereof, wherein $R_6$ and $R_7$ cannot both be $C_1$-$C_4$ alkyl within a single unit; and z is 1-100.

In one example, $R_3$, $R_8$ and $R_4$ are not all $C_1$-$C_4$ alkyl in a single unit.

In yet another example, only one of $R_3$, $R_8$ and $R_4$ is $C_1$-$C_4$ alkyl in a single unit.

In one example, the crosslinking agent comprises an imidazolidinone (Structure V, X=O) where $R_2$=H, Me, Et, Pr, Bu, $(CH_2CH_2O)_pH$, $(CH_2CH(CH_3O)_pH$, $(CH(CH_3)CH_2O)_pH$ where p is 0-100 and $R_1$=methyl. A commercially available crosslinking agent discussed above; namely, Fixapret NF from BASF, has $R_1$=methyl, $R_2$=H.

In another example, the crosslinking agent comprises an imidazolidinone (Structure V, X=O) where $R_2$=H, Me, Et, Pr, Bu and $R_1$=H. Dihydroxyethyleneurea (DHEU) comprises an imidazolidinone (Structure V, X=O) where both $R_1$ and $R_2$ are H. DHEU can be synthesized according to the procedure in EP Patent 0 294 007 A1.

One of ordinary skill in the art understands that in all the formulas above, the carbons to which the $OR_2$ moiety is bonded, also are bonded to a H, which is not shown in the structures for simplicity reasons.

In addition to the above crosslinking agents, additional nonlimiting crosslinking agents suitable for use in the hydroxyl polymer-containing compositions of the present invention include epichlorohydrins, polyacrylamides and other known permanent and/or temporary wet strength resins.

High Polymers

"High polymers" as used herein mean high weight average molecular weight polymers which are substantially compatible with the hydroxyl polymer can be incorporated into the hydroxyl polymer-containing composition. The molecular weight of a suitable polymer should be sufficiently high to effectuate entanglements and/or associations with the hydroxyl polymer. The high polymer preferably has a substantially linear chain structure, though a linear chain having short (C1-C3) branches or a branched chain having one to three long branches are also suitable for use herein. As used herein, the term "substantially compatible" means when heated to a temperature above the softening and/or the melting temperature of the composition, the high polymer is capable of forming a substantially homogeneous mixture with the hydroxyl polymer (i.e., the composition appears transparent or translucent to the naked eye).

The Hildebrand solubility parameter (δ) can be used to estimate the compatibility between hydroxyl polymer and the high polymer. Generally, substantial compatibility between two materials can be expected when their solubility parameters are similar. It is known that water has a $\delta_{water}$ value of 48.0 $MPa^{1/2}$, which is the highest among common solvents, probably due to the strong hydrogen bonding capacity of water. Starch typically has a $\delta_{starch}$ value similar to that of cellulose (about 34 $MPa^{1/2}$).

Without being bound by theory, it is believed that polymers suitable for use herein preferably interact with the hydroxyl polymers on the molecular level in order to form a substantially compatible mixture. The interactions range from the strong, chemical type interactions such as hydrogen bonding between high polymer and hydroxyl polymer, to merely physical entanglements between them. The high polymers useful herein are preferably high weight average molecular weight, substantially linear chain molecules. The highly branched structure of a amylopectin molecule favors the branches to interact intramolecularly, due to the proximity of the branches within a single molecule. Thus, it is believed that the amylopectin molecule has poor or ineffective entanglements/interactions with other hydroxyl polymers, particularly starch molecules. The compatibility with hydroxyl polymer enables suitable high polymers to be intimately mixed and chemically interact and/or physically entangle with the branched amylopectin molecules such that the amylopectin molecules associate with one another via the polymers. The high molecular weight of the polymer enables it to simultaneously interact/entangle with several hydroxyl polymers. That is, the high polymers function as molecular links for hydroxyl polymers. The linking function of the high polymers is particularly important for starches high in amylopectin content. The entanglements and/or associations between hydroxyl polymer and high polymer enhance the melt extensibility of the hydroxyl polymer-containing composition such that the composition is suitable for extensional processes. In one example, it is found that the composition can be melt attenuated uniaxially to a very high draw ratio (greater than 1000).

In order to effectively form entanglements and/or associations with the hydroxyl polymers, the high polymer suitable for use herein should have a weight-average molecular weight of at least 500,000 g/mol. Typically the weight average molecular weight of the polymer ranges from about 500,000 to about 25,000,000, preferably from about 800,000 to about 22,000,000, more preferably from about 1,000,000 to about 20,000,000, and most preferably from about 2,000,000 to about 15,000,000. The high molecular weight polymers are preferred due to the ability to simultaneously interact with several starch molecules, thereby increasing extensional melt viscosity and reducing melt fracture.

Suitable high polymers have a $\delta_{polymer}$ such that the difference between $\delta_{starch}$ and $\delta_{polymer}$ is less than about 10 $MPa^{1/2}$, preferably less than about 5 $MPa^{1/2}$, and more preferably less than about 3 $MPa^{1/2}$. Nonlimiting examples of suitable high polymers include polyacrylamide and derivatives such as carboxyl modified polyacrylamide; acrylic polymers and copolymers including polyacrylic acid, polymethacrylic acid, and their partial esters; vinyl polymers including polyvinylacetate, polyvinylpyrrolidone, polyethylene vinyl acetate, polyethyleneimine, and the like; polyamides; polyalkylene oxides such as polyethylene oxide, polypropylene oxide, polyethylenepropylene oxide, and mixtures thereof. Copolymers made from mixtures of monomers selected from any of the aforementioned polymers are also suitable herein. Other exemplary high polymers include water soluble polysaccharides such as alginates, carrageenans, pectin and derivatives, chitin and derivatives, and the like; gums such as guar gum, xanthum gum, agar, gum arabic, karaya gum, tragacanth gum, locust bean gum, and like gums; water soluble derivatives of cellulose, such as alkylcellulose, hydroxyalkylcellulose, carboxyalkylcellulose, and the like; and mixtures thereof.

Some polymers (e.g., polyacrylic acid, polymethacrylic acid) are generally not available in the high molecular weight range (i.e., 500,000 or higher). A small amount of crosslinking agents may be added to create branched polymers of suitably high molecular weight useful herein.

The high polymer may be added to the hydroxyl polymer-containing composition of the present invention in an amount effective to visibly reduce the melt fracture and capillary breakage of fibers during the spinning process such that fibers having relatively consistent diameter can be spun. These high polymers are typically present in the range from about 0.001 to about 10 wt %, preferably from about 0.005 to about 5 wt %, more preferably from about 0.01 to about 1 wt %, and most preferably from about 0.05 to about 0.5 wt % of the hydroxyl polymer-containing composition. It is surprising to find that at a relatively low concentration, these polymers significantly improve the melt extensibility of the hydroxyl polymer-containing composition.

Hydrophile/Lipophile System

The hydrophile/lipophile system of the present invention comprises a hydrophile component and a lipophile component. The hydrophile/lipophile system exhibits a Tg of less than about 40° and/or less than about 25° to about −30° C. and/or to about −15° C.

Nonlimiting examples of hydrophile/lipophile systems comprise an ingredient selected from the group consisting of: latex grafted starches, styrene/butadiene latexes, vinyl/acrylic latexes, acrylic latexes, acrylate modified latexes, water dispersible fluoropolymers, water dispersible silicones and mixtures thereof.

In one example, the hydrophile/lipophile system exhibits an average particle size (as measured by LB 500, commercially available from Horiba International, Irving, Calif.) of from about 10 nm and/or from about 75 nm and/or from about 100 nm to about 6 μm and/or to about 3 μm and/or to about 1.5 μm. In one example, the hydrophile/lipophile system exhibits an average particle size of from about 10 nm to about 6 μm.

In one example, the hydrophile component and the lipophile component are covalently bonded together.

In another example, the hydrophile component and the lipophile component are not covalently bonded together.

In one example, the hydrophile component and the lipophile component are present in the hydrophile/lipophile system at a weight percent hydrophile component to weight percent lipophile component of from about 30:70 to about 1:99 and/or from about 20:80 to about 5:95.

In still another example, the hydrophile/lipophile system is present in the polymer melt composition of the present invention at a level of from about 0.5% and/or from about 1% to about 3% and/or to about 10% by weight of the starch.

In one example, the hydrophile/lipophile system comprises a discontinuous phase within the hydroxyl polymer. In other words, the hydroxyl polymer may be present in a continuous phase and the hydrophile/lipophile system may be present in a discontinuous phase within the continuous phase of the hydroxyl polymer.

a. Hydrophile Component

Nonlimiting examples of suitable hydrophile components are selected from the group consisting of: alkylaryl sulfonates, ethoxylated alcohols, ethoxylated alkylphenols, ethoxylated amines, ethoxylated fatty acids, ethoxylated fatty esters and oils, glycerol esters, propoxylated & ethoxylated fatty acids, propoxylated & ethoxylated fatty alcohols, propoxylated & ethoxylated alkyl phenols, quaternary surfactants, sorbitan derivatives, alcohol sulfates, ethoxylated alcohol sulfates, sulfosuccinates and mixtures thereof.

b. Lipophile Component

Nonlimiting examples of suitable lipophile components are selected from the group consisting of: saturated and unsaturated animal and vegetable oils, mineral oil, petrolatum, natural and synthetic waxes and mixtures thereof.

c. Surfactant Component

The hydrophile/lipophile system of the present invention may comprise a surfactant component. A nonlimiting example of a suitable surfactant component includes siloxane-based surfactants and organosulfosuccinate surfactants.

One class of suitable surfactant component materials can include siloxane-based surfactants (siloxane-based materials). The siloxane-based surfactants in this application may be siloxane polymers for other applications. The siloxane-based surfactants typically have a weight average molecular weight from 500 to 20,000 g/mol. Such materials, derived from poly(dimethylsiloxane), are well known in the art.

Nonlimiting commercially available examples of suitable siloxane-based surfactants are TSF 4446 and Nu Wet 550 and 625, and XS69-B5476 (commercially available from General Electric Silicones); Jenamine HSX (commercially available from DelCon), Silwet L7087, L7200, L8620, L77 and Y12147 (commercially available from OSi Specialties).

A second preferred class of suitable surfactant component materials is organic in nature. Preferred materials are organosulfosuccinate surfactants, with carbon chains of from about 6 to about 20 carbon atoms. Most preferred are organosulfosuccinates containing dialkyl chains, each with carbon chains of from about 6 to about 20 carbon atoms. Also preferred are chains containing aryl or alkyl aryl, substituted or unsubstituted, branched or linear, saturated or unsaturated groups.

Nonlimiting commercially available examples of suitable organosulfosuccinate surfactants are available under the trade names of Aerosol OT and Aerosol TR-70 (ex. Cytec).

In one example, the surfactant, when present, may be present in the polymer melt composition of the present invention at a level of from about 0.01% to about 0.5% and/or from about 0.025% to about 0.4% and/or from about 0.05% to about 0.30% by weight of the starch.

Other Ingredients

The hydroxyl polymer-containing composition and/or hydroxyl polymer-containing fiber of the present invention may further comprise an additive selected from the group consisting of: plasticizers, diluents, oxidizing agents, emulsifiers, debonding agents, lubricants, processing aids, optical brighteners, antioxidants, flame retardants, dyes, pigments, fillers, other proteins and salts thereof, other polymers, such as thermoplastic polymers, tackifying resins, extenders, wet strength resins and mixtures thereof.

Test Methods

Method A. Fiber Diameter Test Method

A web comprising fibers of appropriate basis weight (approximately 5 to 20 grams/square meter) is cut into a rectangular shape, approximately 20 mm by 35 mm. The sample is then coated using a SEM sputter coater (EMS Inc, Pa., USA) with gold so as to make the fibers relatively opaque. Typical coating thickness is between 50 and 250 nm. The sample is then mounted between two standard microscope slides and compressed together using small binder clips. The sample is imaged using a 10× objective on an Olympus BHS microscope with the microscope light-collimating lens moved as far from the objective lens as possible. Images are captured using a Nikon D1 digital camera. A Glass microscope micrometer is used to calibrate the spatial distances of the images. The approximate resolution of the images is 1 μm/pixel. Images will typically show a distinct bimodal distribution in the intensity histogram corresponding to the fibers and the background. Camera adjustments or different basis weights are used to achieve an acceptable bimodal distribution. Typically 10 images per sample are taken and the image analysis results averaged.

The images are analyzed in a similar manner to that described by B. Pourdeyhimi, R. and R. Dent in "Measuring fiber diameter distribution in nonwovens" (Textile Res. J. 69(4) 233-236, 1999). Digital images are analyzed by computer using the MATLAB (Version. 6.3) and the MATLAB Image Processing Tool Box (Version 3.) The image is first converted into a grayscale. The image is then binarized into black and white pixels using a threshold value that minimizes the intraclass variance of the thresholded black and white pixels. Once the image has been binarized, the image is skeletonized to locate the center of each fiber in the image. The distance transform of the binarized image is also computed. The scalar product of the skeletonized image and the distance map provides an image whose pixel intensity is either zero or the radius of the fiber at that location. Pixels within one radius of the junction between two overlapping fibers are not counted if the distance they represent is smaller than the radius of the junction. The remaining pixels are then used to compute a length-weighted histogram of fiber diameters contained in the image.

Method B. Shear Viscosity of a Hydroxyl Polymer-Containing Composition

The shear viscosity of a hydroxyl polymer-containing composition is measured using a capillary rheometer, Goettfert Rheograph 6000, manufactured by Goettfert USA of Rock Hill S.C., USA. The measurements are conducted using a capillary die having a diameter D of 1.0 mm and a length L of 30 mm (i.e., L/D=30). The die is attached to the lower end of the rheometer's 20 mm barrel, which is held at a die test temperature of 75° C. A preheated to die test temperature, 60 g sample of the polymer melt composition is loaded into the barrel section of the rheometer. Rid the sample of any entrapped air. Push the sample from the barrel through the capillary die at a set of chosen rates 1,000-10,000 seconds$^{-1}$. An apparent shear viscosity can be calculated with the rheometer's software from the pressure drop the sample experiences as it goes from the barrel through the capillary die and the flow rate of the sample through the capillary die. The log (apparent shear viscosity) can be plotted against log (shear rate) and the plot can be fitted by the power law, according to the formula $\eta=K\gamma^{n-1}$, wherein K is the material's viscosity constant, n is the material's thinning index and $\gamma$ is the shear rate. The reported apparent shear viscosity of the composition herein is calculated from an interpolation to a shear rate of 3,000 sec$^{-1}$ using the power law relation.

C. Capillary Number Test Method

When a fluid stream emerges from a die opening, the surface forces (surface tension) between the fluid and the air (or gas) encourage the fluid to break into droplets. Water, emerging from a faucet or a hose, tends to break into droplets instead of maintaining a single stream. This droplet tendency is reduced by raising the fluid velocity (or flowrate) of the fluid, raising the fluid viscosity, or lowering the fluid surface tension. At higher fluid velocities, the fluid will stay as a coherent jet for a greater distance. At higher viscosities, the fluid will also be more stable, such as pouring honey instead of water.

The Capillary number is a dimensionless number used to characterize the likelihood of this droplet breakup. A larger capillary number indicates greater fluid stability upon exiting the die. The Capillary number is defined as follows:

$$Ca = \frac{V * \eta}{\sigma}$$

V is the fluid velocity at the die exit (units of Length per Time), $\eta$ is the fluid viscosity at the conditions of the die (units of Mass per Length*Time), $\sigma$ is the surface tension of the fluid (units of mass per Time$^2$). When velocity, viscosity, and surface tension are expressed in a set of consistent units, the resulting Capillary number will have no units of its own; the individual units will cancel out.

The Capillary number is defined for the conditions at the exit of the die. The fluid velocity is the average velocity of the fluid passing through the die opening. The average velocity is defined as follows:

$$V = \frac{Vol'}{\text{Area}}$$

Vol'=volumetric flowrate (units of Length$^3$ per Time),

Area=cross-sectional area of the die exit (units of Length$^2$).

When the die opening is a circular hole, then the fluid velocity can be defined as $$V = \frac{Vol'}{\pi * R^2}$$

R is the radius of the circular hole (units of length).

The fluid viscosity will depend on the temperature and may depend of the shear rate. The definition of a shear thinning fluid includes a dependence on the shear rate. The surface tension will depend on the makeup of the fluid and the temperature of the fluid.

In a fiber spinning process, the filaments need to have initial stability as they leave the die. The Capillary number is used to characterize this initial stability criterion. At the conditions of the die, the Capillary number should be greater than 1 and preferably greater than 4.

All documents cited in the Detailed Description of the Invention are, in relevant part, incorporated herein by reference; the citation of any document is not to be considered as an admission that it is prior art with respect to the present invention. Terms or phrases defined herein are controlling even if such terms or phrases are defined differently in the incorporated herein by reference documents.

While particular embodiments and/or examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making one or more hydroxyl polymer-containing fibers, the process comprising the steps of:

a. providing a hydroxyl polymer-containing composition comprising an uncrosslinked starch and/or starch derivative and a crosslinking system wherein the hydroxyl polymer-containing composition is free of unmodified, unsubstituted cellulose;

b. supplying a rotary spinning die with the hydroxyl polymer-containing composition; and c. operating the rotary spinning die such that the hydroxyl polymer-containing composition exits the rotary spinning die as one or more hydroxyl polymer-containing fibers.

2. The process according to claim 1 wherein the hydroxyl polymer-containing composition comprises from about 5% to about 100% of the hydroxyl polymer.

3. The process according to claim 1 wherein the hydroxyl polymer-containing composition further comprises polyvinyl alcohol.

4. The process according to claim 1 wherein the hydroxyl polymer-containing composition further comprises a solvent selected from the group consisting of dimethyl sulphoxide, N-methylmorpholine-N-oxide, lithium bromide, water and mixtures thereof.

5. The process according to claim 1 wherein the hydroxyl polymer-containing composition further comprises water.

6. The process according to claim 1 wherein the crosslinking system comprises a crosslinking agent selected from the group consisting of: polycarboxylic acids, imidazolidinones, epichlorohydrins, polyacrylamides and mixtures thereof.

7. The process according to claim 1 wherein the hydroxyl polymer-containing composition further comprises a hydrophile/lipophile system.

8. The process according to claim 1 wherein the hydroxyl polymer-containing composition further comprises a high polymer having a weight average molecular weight of at least 500,000.

9. The process according to claim 1 wherein the hydroxyl polymer-containing composition further comprises an additive selected from the group consisting of: plasticizers, diluents, oxidizing agents, emulsifiers, debonding agents, lubricants, processing aids, optical brighteners, antioxidants, flame retardants, dyes, pigments, fillers, proteins and salts thereof, tackifying resins, extenders, wet strength resins and mixtures thereof.

10. The process according to claim 1 wherein the hydroxyl polymer-containing fiber exhibits a fiber diameter of less than about 50 μm.

11. The process according to claim 1 wherein the process further comprises the step of collecting the hydroxyl polymer-containing fibers on a collection device.

12. The process according to claim 1 wherein the process further comprises the step of collecting the hydroxyl polymer-containing fibers on a collection device such that a web comprising the hydroxyl polymer-containing fibers is formed.

13. The process according to claim 1 wherein the process further comprises the step of humidifying the hydroxyl polymer-containing composition and/or the one or more hydroxyl polymer-containing fibers.

14. The process according to claim 1 wherein the process further comprises the step of drying the one or more hydroxyl polymer-containing fibers.

15. The process according to claim 1 wherein the process further comprises the step of heating the hydroxyl polymer-containing composition and/or the hydroxyl polymer-containing fibers.

16. The process according to claim 1 wherein the process further comprises the step of attenuating the hydroxyl polymer-containing fibers via an attenuating fluid stream.

17. The process according to claim 1 wherein the hydroxyl polymer-containing composition exhibits a viscosity of less than about 300 Pa·s as measured at a shear rate of 3,000 $sec^{-1}$ at a spinning process temperature.

18. The process according to claim 1 wherein the process is operated at a capillary number of greater than 1.

19. The process according to claim 1 wherein the process further comprises a step of subjecting the one or more hydroxyl polymer-containing fibers to electrospinning conditions.

20. A process for making one or more hydroxyl polymer-containing fibers, the process comprising the step of subjecting providing a hydroxyl polymer-containing composition comprising an uncrosslinked starch and/or starch derivative and a crosslinking system to a rotary spinning process such that one or more hydroxyl polymer-containing fibers are produced wherein the hydroxyl polymer-containing composition is free of unmodified, unsubstituted cellulose.

21. A process for making one or more hydroxyl polymer-containing fibers, the process comprising the steps of:

a. providing a first composition comprising a first material;

b. providing a second composition comprising a second material;

c. supplying a rotary spinning die with the first and second compositions; and d. operating the rotary spinning die such that the first and second compositions exit the rotary spinning die as one or more multi-component fibers;

wherein at least one of the first material and second material comprises a hydroxyl polymer-containing composition comprising an uncrosslinked starch and/or starch derivative and a crosslinking system wherein the hydroxyl polymer-containing composition is free of unmodified, unsubstituted cellulose.

22. The process according to claim 21 wherein at least one of the one or more multi-component fibers is in a form selected from the group consisting of: sheath/cost, side-by-side or discontinuous regions of one material being dispersed within another material.

* * * * *

UNITED STATES PATENT AND TRADEMARK OFFICE

CERTIFICATE OF CORRECTION

PATENT NO. : 7,655,175 B2
APPLICATION NO. : 11/016522
DATED : February 2, 2010
INVENTOR(S) : John Gerhard Michael et al.

It is certified that error appears in the above-identified patent and that said Letters Patent is hereby corrected as shown below:

Title Page, should read (*) Notice: Subject to any disclaimers, term of this patent is extended or adjusted under 35 U.S.C. 154(b) by 1055 days.

In Col. 22, line 24 claim 19, the word "cost" should be core.

Signed and Sealed this

Third Day of August, 2010

David J. Kappos

David J. Kappos
*Director of the United States Patent and Trademark Office*